US005573318A

United States Patent [19]

Arabian et al.

[11] Patent Number: 5,573,318

[45] Date of Patent: Nov. 12, 1996

[54] TOWEL DISPENSER

[75] Inventors: Sandro Arabian, Vaduz, Liechtenstein; Manfred Baumann, Diepoldsau, Switzerland

[73] Assignee: CWS International AG, Baar, Switzerland

[21] Appl. No.: 489,828

[22] Filed: Jun. 13, 1995

Related U.S. Application Data

[63] Continuation of Ser. No. 820,662, Mar. 16, 1992, abandoned.

[30] Foreign Application Priority Data

May 15, 1990 [CH] Switzerland ..... 1681/90

[51] Int. Cl.[6] ..... B65H 19/00

[52] U.S. Cl. ..... 312/34.11

[58] Field of Search ..... 312/34.12, 34.11, 312/34.1, 34.8, 34.9, 34.13, 34.16, 34.17

[56] References Cited

U.S. PATENT DOCUMENTS

| | | | |
|---|---|---|---|
| 3,348,891 | 10/1967 | Schumm | 312/34.12 |
| 3,506,320 | 4/1970 | Howlett | 312/34.12 |
| 3,858,951 | 1/1975 | Rasmussen | 312/34.12 |
| 3,920,294 | 11/1975 | Kulik | 312/34.12 |
| 3,951,485 | 4/1976 | Schnyder et al. | 312/34.12 |
| 3,971,607 | 7/1976 | Schnyder | 312/34.12 |
| 4,270,818 | 6/1981 | McCabe | 312/34.12 X |
| 4,573,750 | 3/1986 | Golby | 312/34.12 |
| 4,746,176 | 5/1988 | Nishiyama et al. | 312/38 |
| 4,826,262 | 5/1989 | Hartman et al. | 312/34.12 |
| 4,828,343 | 5/1989 | Murano | 312/34.12 |
| 4,848,854 | 7/1989 | Kennedy | 312/34.12 |

FOREIGN PATENT DOCUMENTS 0283554 9/1988 European Pat. Off. ..... A47K 10/28

*Primary Examiner*—Michael Powell Buiz
*Assistant Examiner*—Nancy Mulcare
*Attorney, Agent, or Firm*—Cushman Darby & Cushman, L.L.P.

[57] ABSTRACT

Unused towel rolled up in a shell (4) is guided between a roller (38) and a tracer (40) for detecting the towel end and via a transport roller (6*a*), forms a loop and runs via a transport roller (6b) to a roller (13) guided in slots (14*a,b*) and intended for receiving used towel. To ascertain whether the loop is being used or not, there is a movement sensor (20) with a bar (22) which is suspended rotatably about a horizontal axis and to which is attached a batten (23) via which the towel (5) is guided. Clamped in the bar (22) is the upper end of a piezoelectric element which at its lower end is clamped between parts connected to a sensor housing (21). Since a distinction can be made between use and non-use, it is possible for released unused towel to be retracted again. Various programs can be selected for operating the towel dispenser, and in particular the loop can be formed from unused and used towel or only from unused towel.

8 Claims, 8 Drawing Sheets

TOWEL DISPENSER

This is a continuation of application Ser. No. 07/820,662, filed on Mar. 16, 1992, which was abandoned upon the filing hereof.

The invention relates to a towel dispenser according to the pre-characterising clause of claim 1.

There are known towel dispensers of the relevant generic type (CH-A-0,561,535), in which, after a trip by a device to be actuated by the user, for example a light barrier, a proximity or touch-contact switch or a pushbutton, a portion of unused towel is released and, after a specific period of time, drawn in as used towel, without a check being made as to whether use has actually occurred or not. Towel dispensers of this type afford only the possibility of a program which, after a trip, runs without regard for external events, and in addition to other disadvantages this often leads to a waste of clean towel, particularly as a result of faulty trips, so that the towel web has to be washed more often. However, it is desirable both for economic and for ecological reasons to be as sparing as possible with clean towel and to avoid an unnecessary shortening of the washing intervals.

There are, furthermore, known mechanical towel dispensers (EP-A-0,283,554), in which unused towel is drawn out of a housing by the user, thereby tensioning a spring motor, by means of which used towel is drawn in after a fixed period of time has elapsed. In this proven system, although the possibility of actual faulty trips is prevented, nevertheless the preconditions for a flexible adaptation of the program to external circumstances, particularly the duration of use, are not provided, and this can lead to needless waiting times, for example when there is a large crowd.

The invention is intended to remedy this. The invention, as characterised in the claims, provides a towel dispenser which records the acts of use, etc. and which can thereby adapt flexibly to external circumstances. In particular, the preconditions for drawing in again already released towel after the absence of a use are also provided, and consequently the possibility of an extremely sparing handling of clean towel, even though the towel release takes place electrically and the user is not required to carry out any mechanical actuation of the device. Many possibilities are available in the choice of trip mechanism.

The advantages of the invention are also to be seen in that it affords many possibilities of adopting particular conditions of use with special programs which can be selected by the maintenance and assembly personnel or the manager. Even the replacement of used towel webs by unused ones can be assisted by a program and thus simplified and speeded up.

Figure 1:
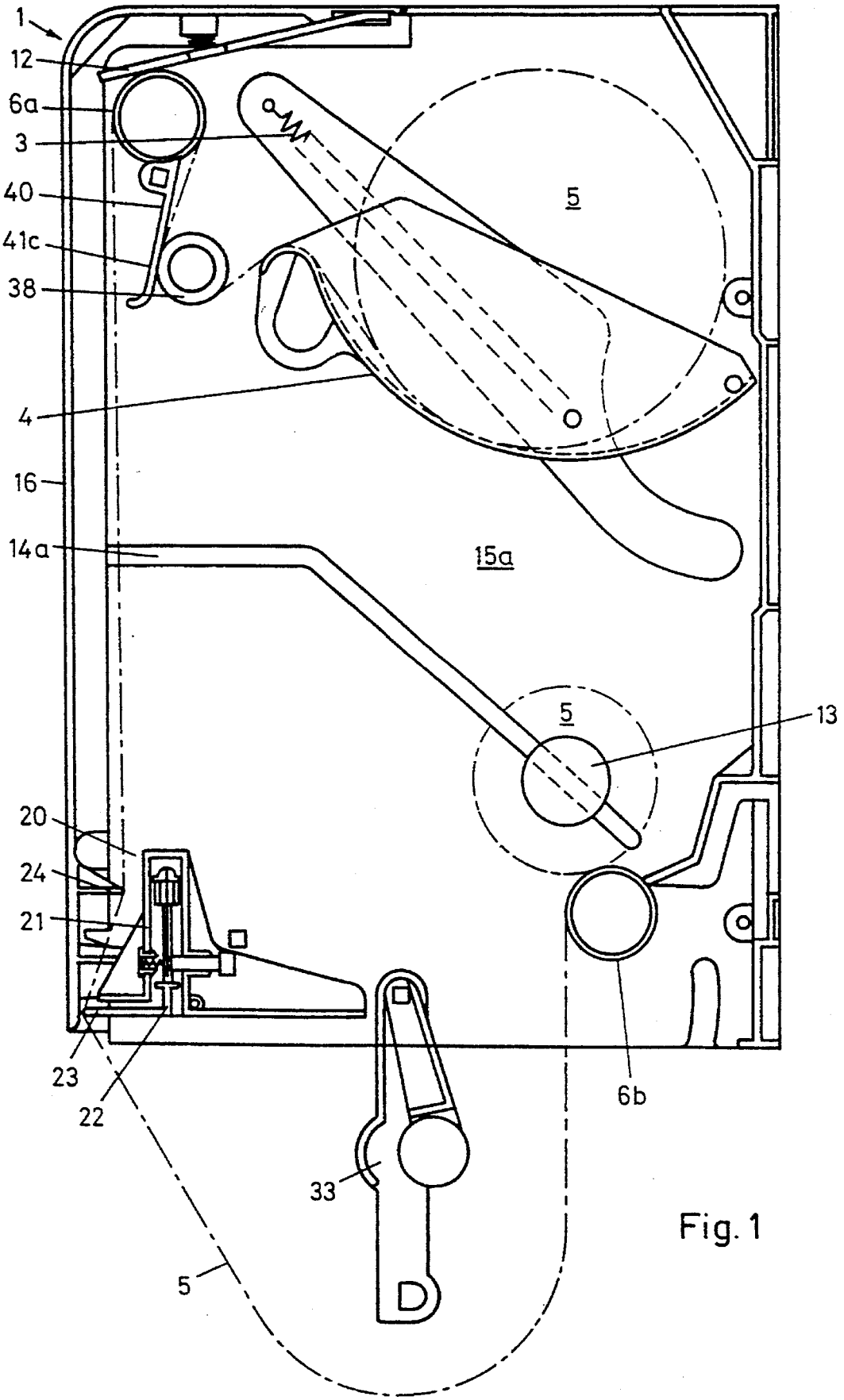
Figure 2:
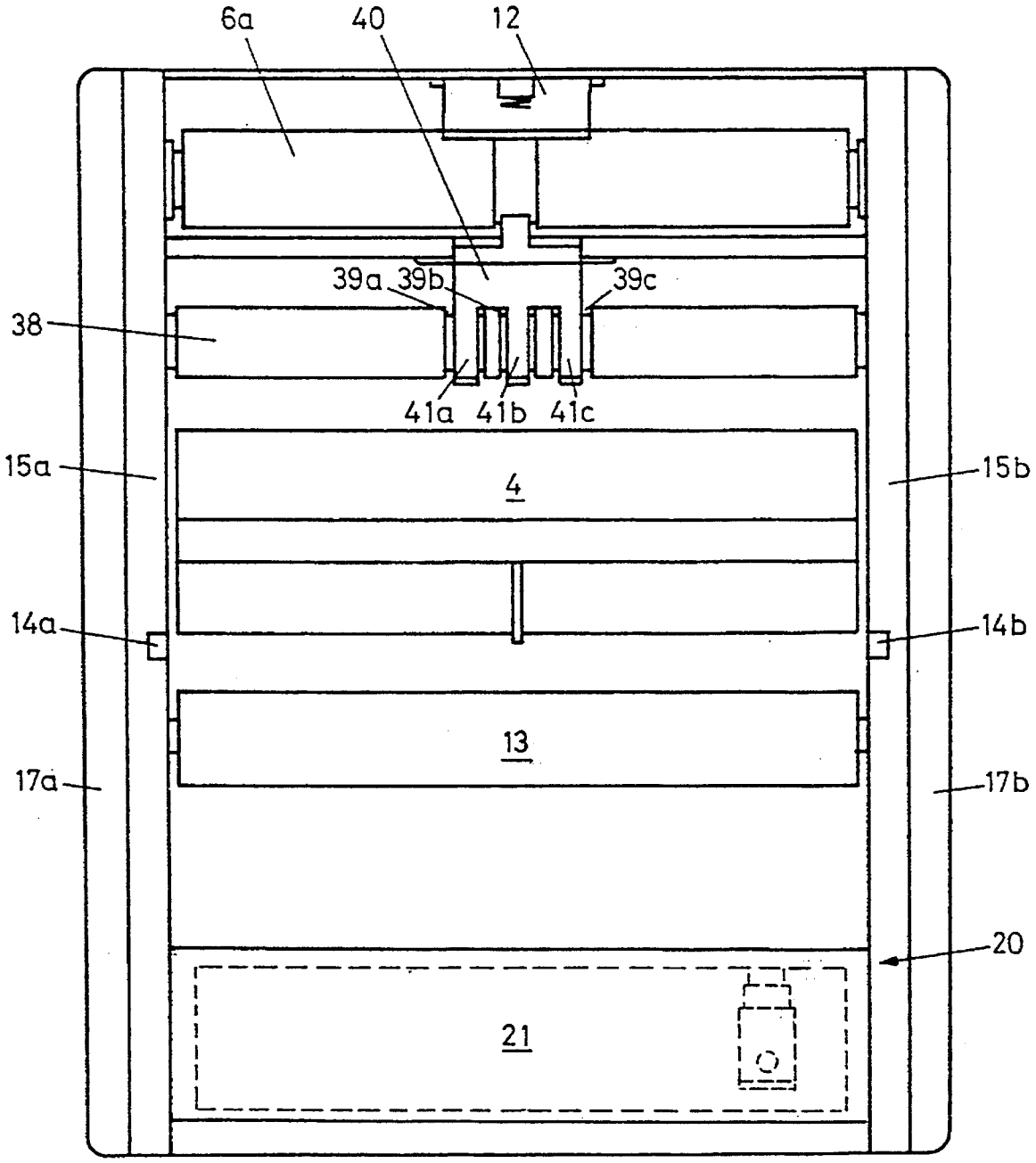
Figure 3:
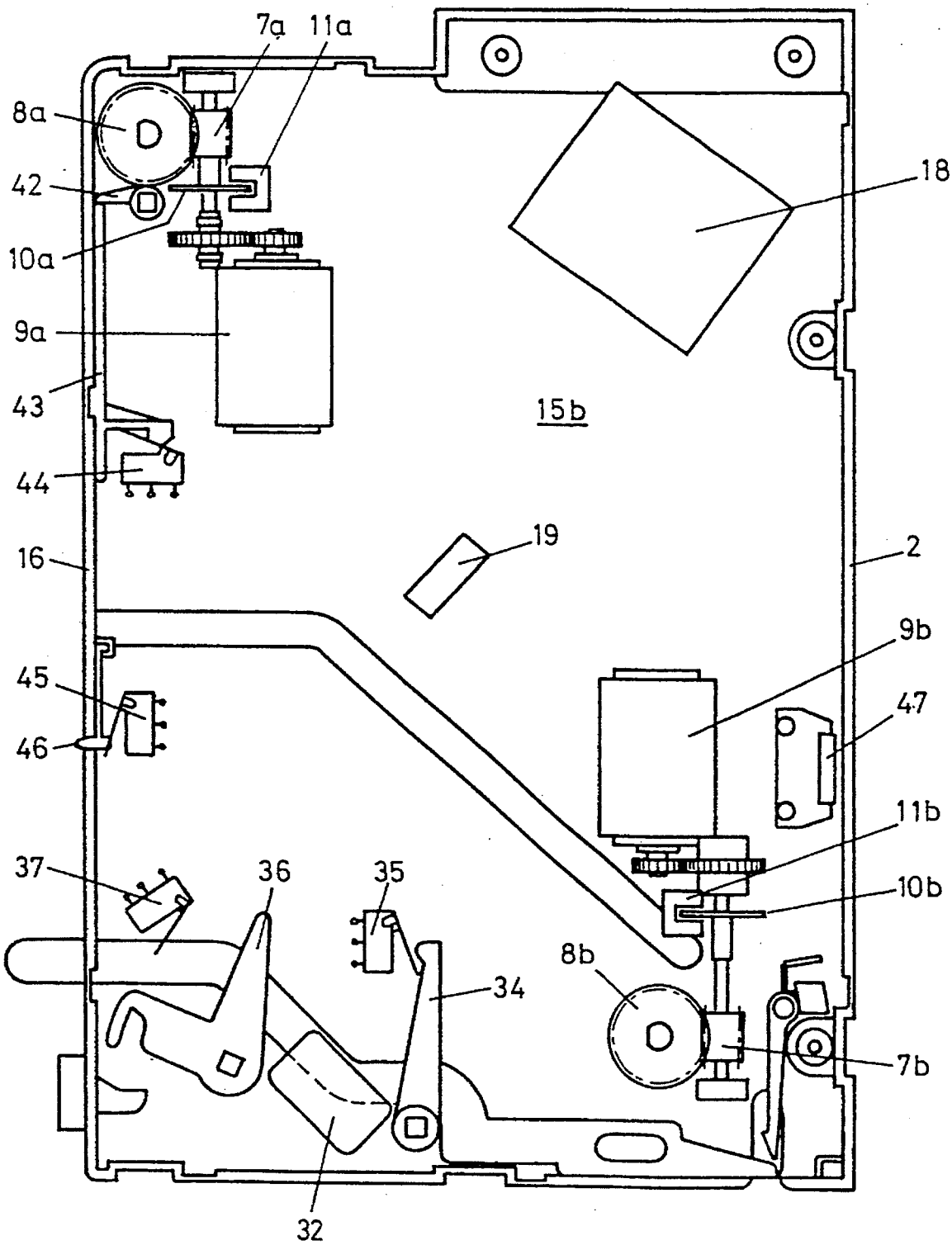
Figure 4:
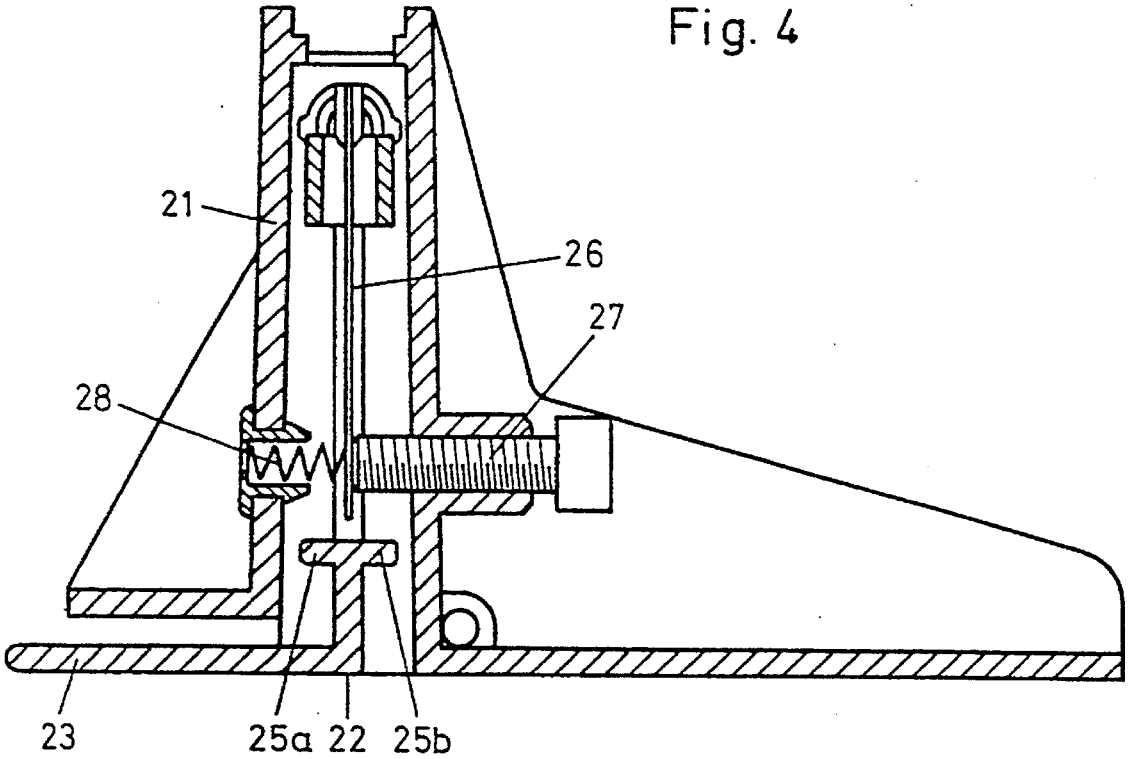
Figure 5:
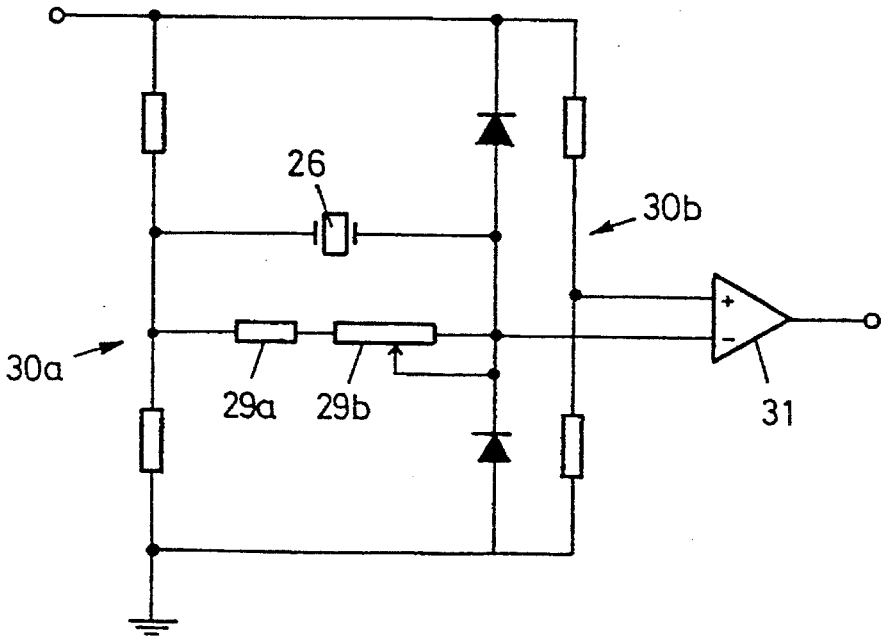
Figure 6:
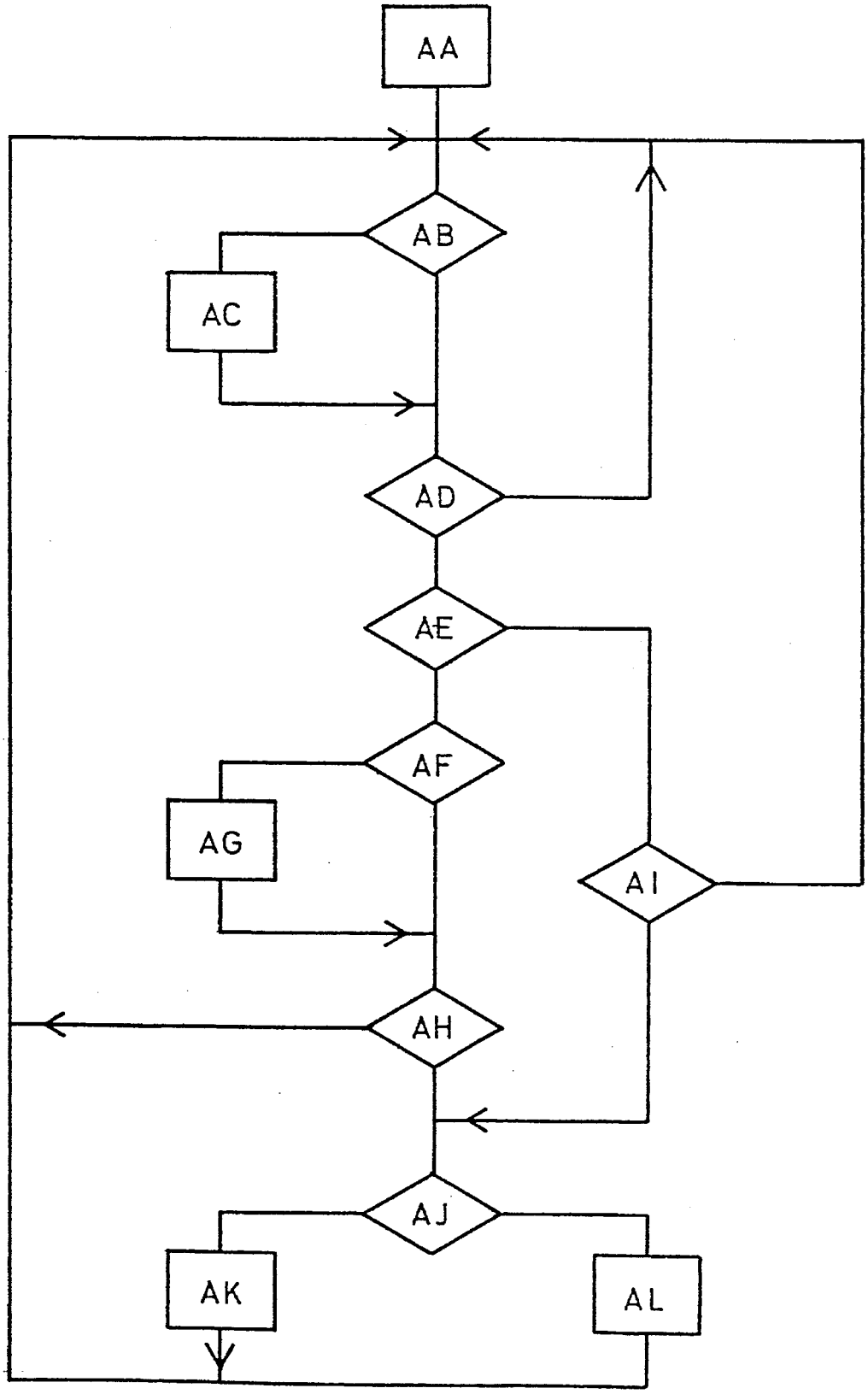
Figure 7A:
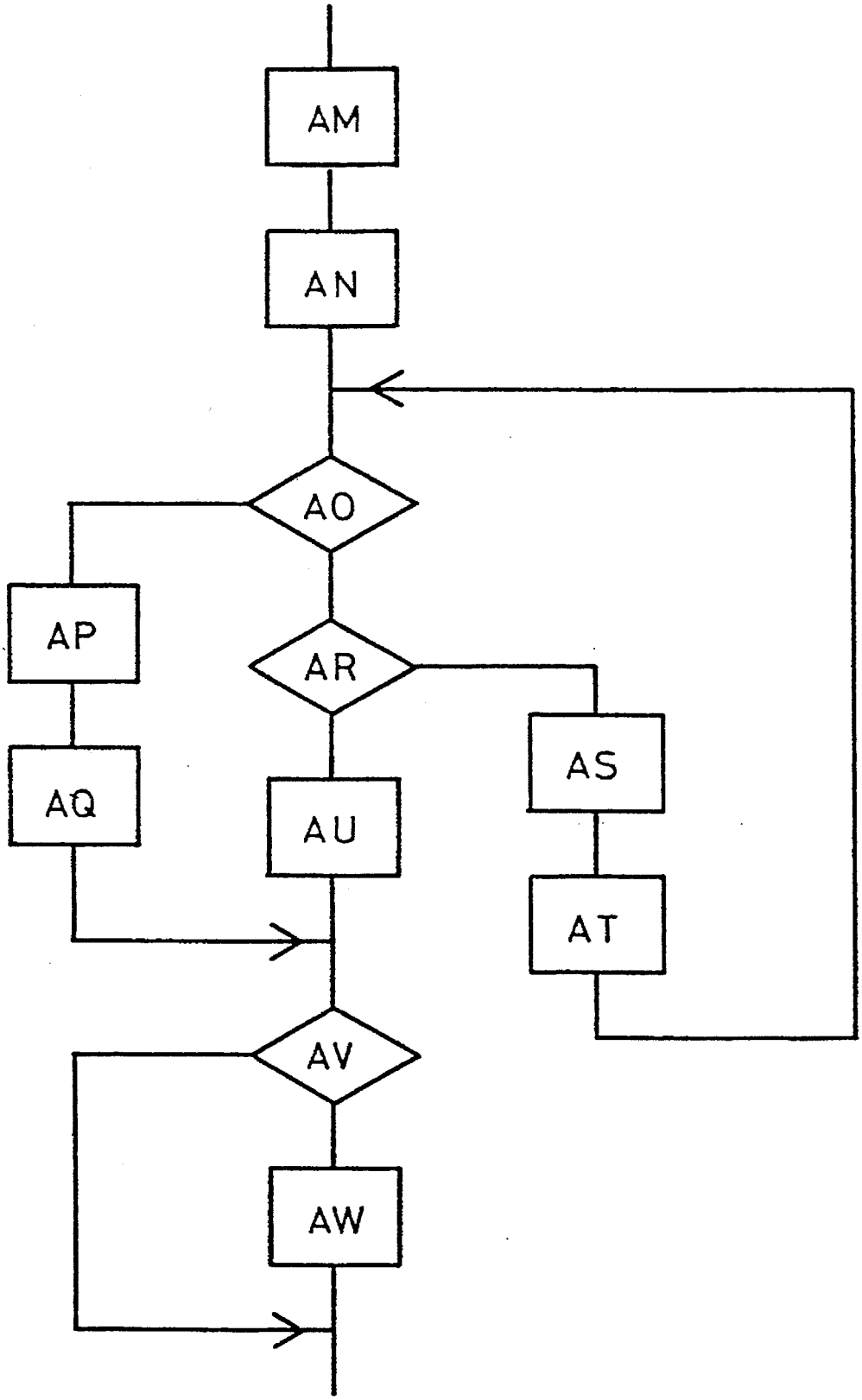
Figure 7B:
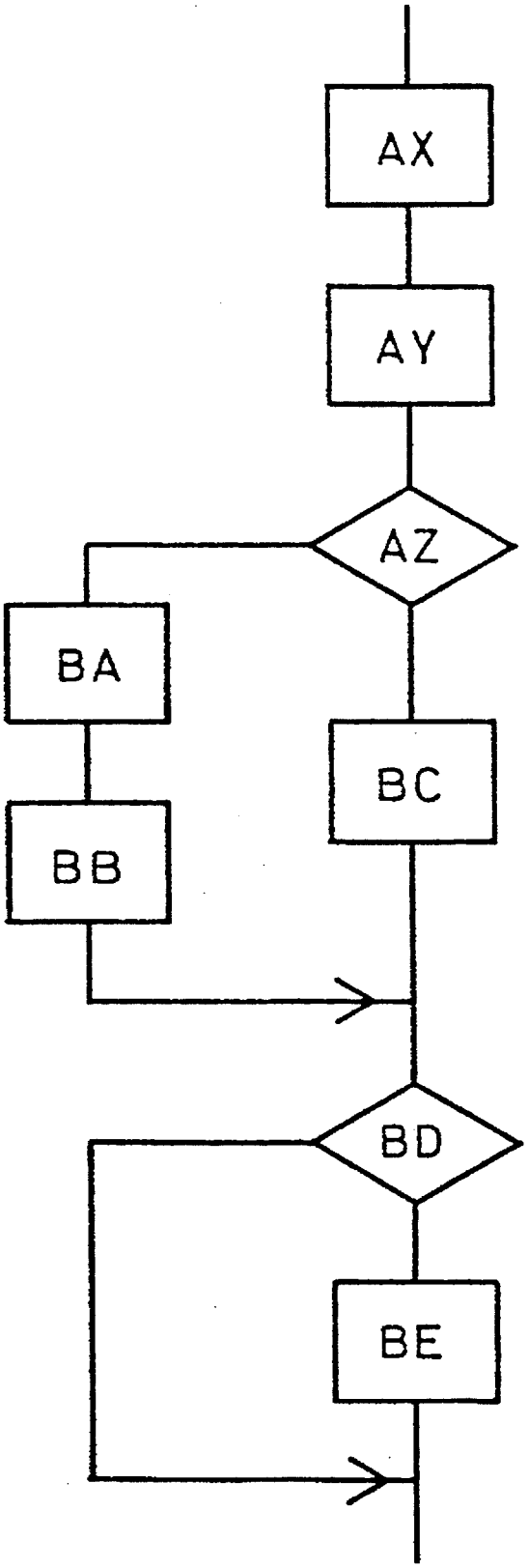
Figure 8:
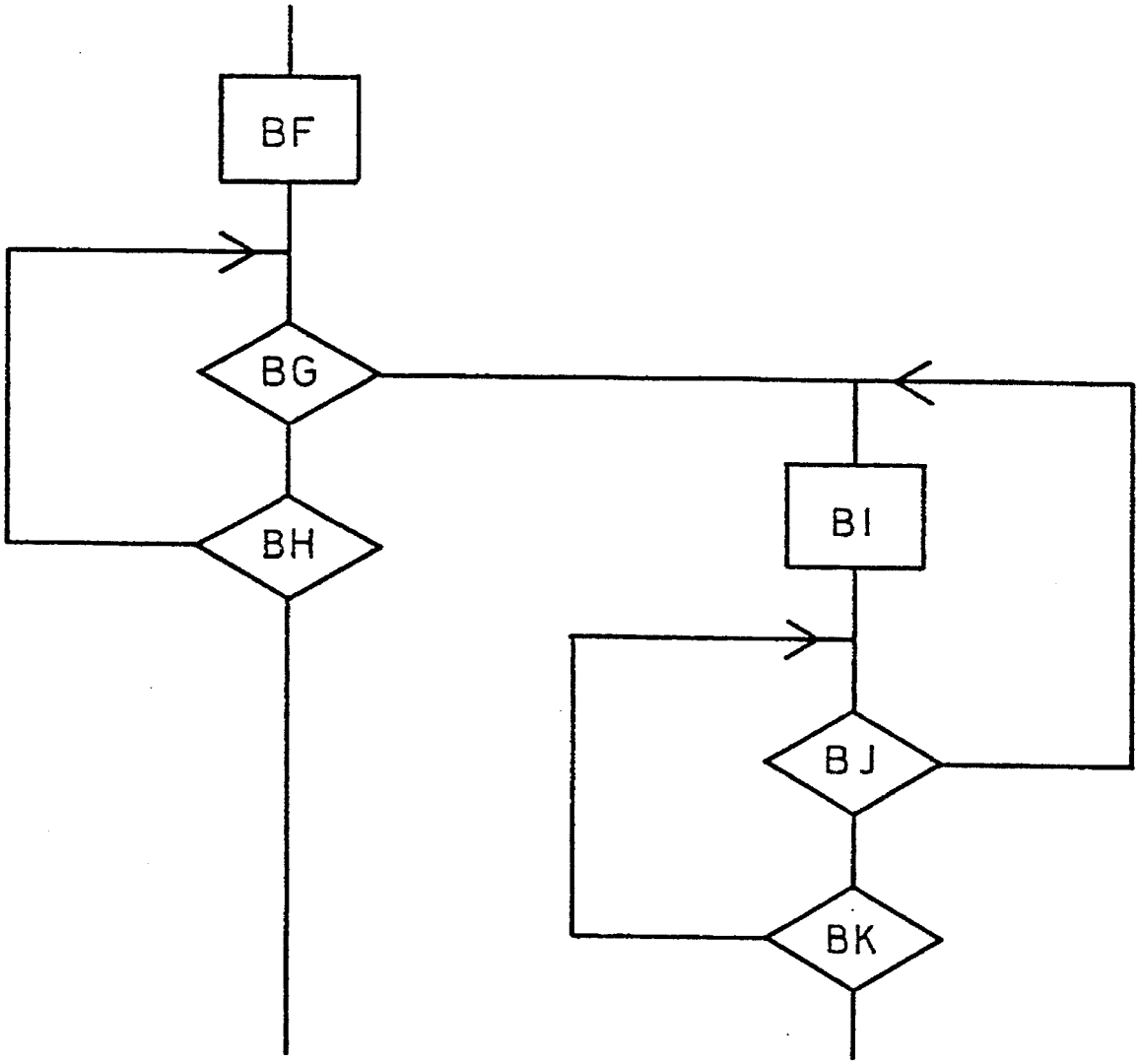

The invention is explained in more detail below by means of Figures illustrating merely one exemplary embodiment. Of these:

FIG. 1 shows a top view of the right-hand side of a towel dispenser according to the invention with the towel inserted, the side wall being omitted, FIG. 2 shows a front view of the towel dispenser, a front cover being omitted, FIG. 3 shows a top view of the right-hand side wall of the towel dispenser, a lateral cover being omitted, FIG. 4 shows enlarged a cutout from FIG. 1 illustrating a movement sensor, FIG. 5 shows a circuit belonging to the movement sensor, FIG. 6 shows a flow diagram illustrating a method for operating the towel dispenser according to the invention, above all the parts run through in a state of rest being shown in detail, FIG. 7*a* shows a flow diagram illustrating in detail the steps run through after a trip in a standard program, FIG. 7*b* shows a flow diagram illustrating in detail the steps run through after a trip in a special hygiene program, and FIG. 8 shows a further flow diagram illustrating in detail the detection of a use of the towel.

FIGS. 1 to 5 show a towel dispenser according to the invention comprising, in a housing 1 mounted on a wall by means of its rear wall 2, a tiltably suspended shell 4 loaded by springs 3 with an upwardly acting force and intended for receiving an unused towel web 5 (represented by a dashed line) wound to form a roll, as well as a first transport device with a transport roller 6*a* which is covered with knobbed rubber and which is driven from an electric motor 9*a* via a worm gear consisting of a worm 7*a* and of a gearwheel 8*a* connected to the transport roller 6*a*. A half-disc 10*a* fastened to the worm 7*a* forms, with a fixed light barrier 11*a* detecting passages of the half-disc 10*a*, a revolution counter. The gearwheel 8*a* is connected to the transport roller 6*a* via a slip coupling which responds when a pull of more than 4 kp acts on the towel 5. The towel 5 is pressed against the transport roller 6*a* by a sprung pressure plate 12. A second drive device is constructed in a similar way to the first with a transport roller 6*b*, a worm gear with worm 7*b*, gearwheel 8*b* and electric motor 9*b* and a revolution counter with a half-disc 10*b* and a light barrier 11*b*. For receiving used towel, a roller 13 is guided in slots 14*a,b* in side walls 15*a,b* of the housing 1. The housing is closed at the front by means of a cover 16 which is secured by a lock, so that it can be opened only by authorised personnel for maintenance purposes, especially for a towel change. The housing 1 possesses on its sides covers 17*a,b*. The power supply of the appliance is guaranteed by a power unit 18.

According to the invention, the towel dispenser has a central control unit 19 which processes the signals from various sensors and which, in particular, controls the transport devices. To determine movements of the towel 5 caused by external action, the towel dispenser has a movement sensor 20 with a bar 22 which is suspended rotatably in a sensor housing 21 and at the lower end of which projects horizontally a batten 23, over the front end of which the towel 5 is so guided by means of a deflecting fence 24 that, even in the non-tensioned state, because of its own weight it exerts a force on this. The bar 22 is suspended in such a way that, in the event of deflections, a return force occurs which ensures that it is deflected only a little out of its vertical position of rest by the forces exerted on it by the towel 5 at rest. Under higher forces transmitted by the towel 5, stops 25*a,b* limit the deflection. Mounted in a rectangular recess of the bar 22 is a piezoelectric element 26 which is designed as a rectangular strip and which with a first contact region is clamped firmly at its upper edge in the bar 22 and in a second contact region in the vicinity of its lower end is clamped between a threaded bolt 27 screwed into the sensor housing 21 and a helical spring 28 coaxial with the threaded bolt 27 and likewise fastened to the sensor housing 21. The threaded bolt can be adjusted perpendicularly relative to the plane of the piezoelectric element 26 by rotation. Since the elastic piezoelectric element 26 provides at least some of the return force for the bar 22, the neutral position of the bar 22 can therefore be adjusted. The output signal for the piezoelectric element 26 is processed in the circuit shown in FIG. 5, which essentially constitutes a limit-value detector. Under a constant bending moment, the piezoelectric element 26 is electrically inactive. Changes of the bending moment, which are caused by movements of the bar 22 brought about by external actions on the towel 5, give rise to a current surge. It has been shown, in practice, that a change of the bending moment in one direction is always followed very quickly by a change in the opposite direction, so that current surges of differing sign always succeed one another rapidly, and therefore only one of these need be detected. The piezoelectric element 26 is connected in parallel to the resistors 29*a,b* which serve for deriving the current surge and of which 29*b* can be varied to adjust the voltage generated by the piezoelectric element 26, between a first voltage divider 30*a* and the negative input of a comparator 31, to the positive input of which the output of a second voltage divider 30*b* is applied. The voltage dividers are at a supply voltage of +5 V and are so designed that the output voltage of the second voltage divider 30*b* is somewhat lower than that of the first voltage divider 30*a*, with the result that the output of the comparator 31 is normally at "zero". Now if a sufficiently strong voltage surge of negative polarity caused by the piezoelectric element 26 is superposed on the output voltage of the first voltage divider 30*a*, the voltage at the negative input of the comparator 31 falls below the output voltage of the second voltage divider 30*b* applied to the positive input, so that the output signal of the comparator 31 jumps to "one".

An infrared sensor 32 monitors the space sector located underneath to obliquely underneath the towel dispenser for heat-radiating objects.

A rotatably suspended flap 33, around which the towel 5 is guided, is connected to a lever 34 which activates a microswitch 35 when the towel 5 is fully tensioned and presses the flap 33 completely upwards. A further lever 36 interacts with a further microswitch 37. The lever 36 actuates the microswitch 37 when the lock (not shown) is blocked. The blocking of the lock is only possible when the cover 16 is closed.

Between the shell 4 and the transport roller 6*a*, the towel 5 is guided via a roller 38 which has three continuous grooves 39*a,b,c*. A feeler 40 suspended rotatably on an axle parallel to the roller 38 has three fingers 41*a,b,c* which are pressed against the grooves 39*a,b,c* under the influence of spring force acting on the feeler 40. When the towel end passes the roller 38, the fingers 41*a,b,c* can be pressed onto the bottom of the grooves 39*a,b,c*, and the feeler 40 executes a rotation in the anti-clockwise direction. A lever 42 connected to it thereby actuates a microswitch 44 via a connecting rod 43. A further microswitch 45 detects actuations of a starting-aid button 46. All the sensors and microswitches are connected to the control unit 19.

A plug 47 serves for connecting the towel dispenser to a second towel dispenser of the same type normally mounted next to it.

The method according to the invention is explained below by means of FIGS. 6 to 8.

At AA in FIG. 6, for example after the towel dispenser has been switched on, the control unit 19 is initialised, whereupon it executes various initialisations and checks of further elements. Upon conclusion of these operations, at AB the microswitch 37 is interrogated, that is to say it is ascertained whether the cover 16 is closed and blocked. If not, it is assumed that a fresh towel web is being loaded, and the check passes on to a towel-loading program AC.

The towel change takes place, in that, first, after the complete opening of the cover 16, the roller 13, on which the used towel is wound, is drawn forwards out of the slots 14*a,b*, then the shell 4 is tilted downwards and the fresh towel roll inserted, and thereafter the towel 5 is drawn through between the roller 38 and the feeler 40 and subsequently over the transport roller 6*a*. The starting-aid button 46 is then actuated, this causing approximately 1.3 m of towel to be released by the first transport device. The towel end is then wound around a new roller 13, and this is moved around the movement sensor 20 and the flap 33 and introduced with its ends into the slots 14*a,b*, until it or the towel wound on it touches the transport roller 6*b*. Subsequently, the flap 33 is pressed upwards and the cover 16 is closed and blocked, this being recorded by the microswitch 37 and triggering a complete drawing in of the towel 5, with the exception of a towel residue, by the second transport device. The microswitch 35 indicates to the control unit 19 that the towel 5 is completely drawn in, that is to say tensioned, whereupon the control unit stops the electric motor 9*b*. The towel-loading program AC is thus terminated, and the check passes on to AD. If it is ascertained at AB that the cover 16 is closed and blocked, the check passes directly on to AD. At AD, the state of the microswitch 44 is interrogated and it is ascertained whether the towel end is reached or whether there is still a stock of fresh towel. If the towel end is reached, a pilot lamp on the housing 1 lights up and the check returns to AB. Thereafter, there is only a periodic check as to whether the cover 16 is closed and blocked or is open.

If there is still towel available, a check is conducted at AE as to which trip mechanism has been selected for the release of towel. There are two possibilities here: the trip can be made by the infrared sensor 32 which indicates when a person probably wanting to use the towel dispenser approaches, or by the movement sensor 20 which records movements of the towel 5. In the first instance, the check passes on to AF, where it is ascertained by means of the microswitch 35 whether the towel 5 is tensioned. If not, at AG the second transport device is activated, until the periodic check produces a positive result. In this case, in the same way as with the result positive from the outset, the program goes on to AH, where a check is made as to whether the infrared sensor 20 responds. If not, the check returns to AB. If a trip by the movement sensor 20 has been selected, this being advisable, above all, in confined conditions to prevent faulty trips, the check passes from AE to AI, where a check is made in the way already described above as to whether the movement sensor 20 indicates that the towel has been touched. To allow this type of trip, whenever the towel 5 has been tensioned, a piece of towel of a length of 8 cm is released by the first transport device, so that the accessible towel residue forms a short loop which the user can grasp.

In the state of rest, that is to say as long as there has been no trip, the program parts described hitherto are run through periodically. In the event of a trip, irrespective of whether it has been caused by the infrared sensor 32 or by the movement sensor 20, the check passes on to AJ, where the inquiry is made as to whether the towel dispenser is to be operated according to a standard program AK or according to a hygiene program AL. After the execution of one of these programs, there is a return to AB.

The standard program AK illustrated in detail in FIG. 7*a* begins with the step AM, where 32 cm of unused towel is normally released by the first transport device. However, an economy program with a release of 27 cm of towel can be selected. The length of the released towel portion is checked by means of the revolution counter. One revolution of the worm 7*a* corresponds to approximately 3 mm of towel. Subsequently, at AN, normally 15 cm and in the economy program 10 cm of used towel is released by the second transport device. So that the front side of the loop consists solely of unused towel, less used than unused towel is dispensed. The length check is conducted in the same way as for the unused towel. The dispensing of used towel has the advantage of saving fresh towel, whilst at the same time preserving ease of use by the provision of a sufficiently large loop. The user will normally not touch the rear part of the loop and therefore not come in contact with towel used by his predecessor.

In the next step AO, it is ascertained by means of the movement sensor 20 whether the released towel has been used or not. This check will be explained in detail further below. If no use is detected, at AP the released unused towel is retracted again completely. This step obviously affords possibilities of great savings, since, especially where a trip by an infrared or other proximity sensor is concerned, faulty trips by persons passing the towel dispenser occur very easily. In the method according to the standard program, such trips without subsequent use result in no waste of unused towel. In the following step AQ, towel is drawn in by the second transport device, until it is completely tensioned and only a towel residue is still accessible.

If use is detected at AO, the check is first made at AR as to whether the towel dispenser is being operated according to a normal program or a fast program. In the latter case, at AS, unused towel, once again 32 cm in the normal case and 27 cm in the economy program, is released, and subsequently, at AT, 32 cm or 27 cm of used towel is drawn in, whereupon there is a return to AO. In the fast program, therefore, unused towel is dispensed not only before used towel is drawn in, but also without waiting for a trip. This is possible without a waste of towel only because a check is made as to whether a use takes place and, in the event of non-use, the unused towel is drawn in again, whereupon the state of rest is then assumed. It is expedient to select the fast program, above all, when a crowd is to be expected.

If the normal program has been selected, at AU used towel is drawn in as far as it will go, in the same way as at AQ. At AV, the trip mechanism is determined. If the trip is made by the infrared sensor 20, the standard program AK is abandoned and there is a return to AB, that is to say to the state of rest. If the trip is made by the movement sensor 20, 8 cm of unused towel is released beforehand at AW in order to form a short loop.

In addition to the standard program AK, there is a hygiene program AL which has been developed specially for hospitals and other environments demanding especially stringent hygiene requirements, such as, for example, food production companies, laboratories, etc. Particular importance has been placed on ensuring that the user cannot under any circumstances come into contact with a towel portion which has been touched by another user. Only fresh unused towel is made accessible to each user. Furthermore, a somewhat longer towel portion than in the standard program is provided each time.

At AX, 64 cm of unused towel is normally released. Here too, however, there is an economy program in which a portion of a length of only 54 cm is released. Thereupon, at AY, 17 cm is drawn in by the second transport device, and consequently the towel residue accessible before the trip is made inaccessible. It is ascertained at AZ whether a use has taken place. If not, at BA, 41 cm or, in the economy program, 31 cm is retracted again, whereupon, at BB, the towel is drawn in on the draw-in side as far as it will go. Here too, therefore, the saving obtained by drawing unused towel in again in the event of non-use is considerable, although it is not drawn in again completely. If no use is ascertained at AZ, the towel is drawn in as far as it will go only at BC in the same way as at BB. At all events, the check passes on to BD, where the trip mode is interrogated. In a similar way to the standard program AK, if the trip is made by the infrared sensor 32 there is an immediate return to AB, whilst if it is made by the movement sensor 20, 8 cm of unused towel is previously released at BE, so that the accessible towel residue forms a small loop.

It should also be mentioned that, since the shell 4 is usually drawn downwards by the towel 5 when unused towel is released, to protect the springs 3 the release always takes place in such a way that 2 cm of towel is additionally dispensed and drawn in again immediately thereafter. It thereby becomes possible for the shell 4 to be raised.

The detection of a use, carried out both in the standard program AK (step AO) and in the hygiene program AL (step AZ), is now explained by means of FIG. 8. At BF, a timer is set at a running time of 20 seconds. A check is made at BG as to whether the movement sensor 20 has detected a movement imparted to the towel. If not, a check is made at BH as to whether the timer is still set. If so, there is a return to BG, otherwise it is determined that no use has taken place. If it is established at BG that the towel is being moved, at BI a further timer is set at a running time of 3 seconds, and thereupon a check is made again at BJ as to whether the movement sensor 20 has detected a movement. If so, there is a return to BI that is to say the timer is reset to the start of the running time. If no movement of the towel is detected at BJ, a check is made at BK as to whether the timer is still set. If so, there is a return to BJ, otherwise a use is determined. The loops BG—BH BG and BJ—BK—BJ are each run through 64,000 times per second. Since the voltage pulses generated by the piezoelectric element 26 have a duration of at least a few milliseconds, any movement going beyond an adjustable threshold is reliably detected.

Thus, if after the formation of the loop, the towel 5 is not touched for a standby period of 20 seconds, no use is determined and the released unused towel 5 is retracted again completely (standard program AK) or partially (hygiene program AL). If the towel 5 is touched, a check is made as to whether the loop is being touched, until no movement has been detected for a waiting time of 3 seconds. The user therefore has as much time as he wishes to use the towel. Only when he has not touched it for at least 3 seconds is it established that a use has taken place and is concluded and the next step initiated.

By means of the plug 47, when it has been established at AD that the towel 5 is used up, an adjacent identical towel dispenser can be activated, and moreover various program parameters can be transferred, so that the second towel dispenser functions in exactly the same way as the first (standard/hygiene program, etc).

It is also possible to provide a transmission of information between towel dispensers and a central station either via the power line or via separate lines. Thus, information on the state of the towel dispenser, especially the towel stock, can be transmitted to the central station, and conversely commands, for example for a program change-over, to the towel dispenser.

We claim:

1. A towel dispenser comprising:

(a) a housing defining at least one orifice;

(b) a first electrically driven transport device for providing an unused towel portion through said at least one orifice;

(c) a second electrically driven transport device for retracting a used towel portion through said at least one orifice;

(d) control means for controlling said first electrically driven transport device and said second electrically driven transport device;

(e) a movement sensor electrically connected to said control means, said movement sensor including;

(i) a touch-contact element; and (ii) a piezoelectric element having a first contact region operatively associated with said touch-contact element and a second contact region operatively associated with said housing.

2. A towel dispenser as recited in claim 1, wherein said touch-contact element is configured as a batten projecting from a bar member in said housing.

3. A towel dispenser as recited in claim 2, wherein said piezoelectric element is configured as a strip member with said first contact region being fastened to said bar member of said touch-contact element and said second contact region being disposed between a clamping member operatively associated with said housing and a spring member being operatively associated with said housing.

4. A towel dispenser as recited in claim 3, wherein said clamping member is Configured as a threaded bolt mounted in adjustable relationship to said piezoelectric element.

5. A towel dispenser as recited in claim 4, wherein said spring member is configured as a helical spring mounted in coaxial relationship with said threaded bolt.

6. A towel dispenser comprising:

(a) a housing defining at least one orifice;

(b) a first electrically driven transport device for providing an unused towel portion through said at least one orifice;

(c) a second electrically driven transport device for retracting a used towel portion through said at least one orifice;

(d) control means for controlling said first electrically driven transport device and said second electrically driven transport device;

(e) a movement sensor electrically connected to said control means, said movement sensor including means for adjusting the sensitivity of said movement sensor.

7. A towel dispenser as recited in claim 6, wherein said movement sensor further includes a touch-contact element and a piezoelectric element having a first contact region operatively associated with said touch-contact element and a second contact region operatively associated with said housing.

8. A towel dispenser as recited in claim 6, wherein said adjusting means is a threaded bolt operatively associated with said movement sensor.

* * * * *

UNITED STATES PATENT AND TRADEMARK OFFICE

CERTIFICATE OF CORRECTION

PATENT NO. : 5,573,318
APPLICATION NO. : 08/489828
DATED : November 12, 1996
INVENTOR(S) : Arabian et al.

It is certified that error appears in the above-identified patent and that said Letters Patent is hereby corrected as shown below:

On the title page:

add item [86], to include:
--PCT No.: PCT/CH91/00105--;
--§ 371 Date: March 16, 1992--;
--§ 102(e) Date: March 16, 1992--; and add item [87], to include:
--PCT Pub. No.: WO91/17691--;
--PCT Pub. Date: November 28, 1991--.

Signed and Sealed this

Twenty-ninth Day of July, 2008

JON W. DUDAS
*Director of the United States Patent and Trademark Office*